US006428743B1

(12) United States Patent
Stoupis et al.

(10) Patent No.: US 6,428,743 B1
(45) Date of Patent: Aug. 6, 2002

(54) TROUGH HAVING AN EROSION-RESISTANT PRECAST SHAPE

(75) Inventors: George M. Stoupis; Jeffrey S. Chadwick, both of Allegheny County; David O'Connor, Lancaster County, all of PA (US)

(73) Assignee: Vesuvius Crucible Company, Wilmington, DE (US)

( * ) Notice: Subject to any disclaimer, the term of this patent is extended or adjusted under 35 U.S.C. 154(b) by 12 days.

(21) Appl. No.: 09/679,696

(22) Filed: Oct. 5, 2000

(51) Int. Cl.[7] ..... C21B 7/14

(52) U.S. Cl. ..... 266/196; 266/231; 266/286; 264/36

(58) Field of Search ..... 266/196, 286, 266/44, 231, 281; 264/30, 36

(56) References Cited

U.S. PATENT DOCUMENTS 4,526,351 A * 7/1985 LaBate ..... 266/196
4,573,668 A * 3/1986 LaBate ..... 266/196
5,494,267 A * 2/1996 Anderson et al. ..... 266/281
5,511,762 A * 4/1996 Connors, Jr. et al. ..... 264/30

* cited by examiner

*Primary Examiner*—Scott Kastler
(74) *Attorney, Agent, or Firm*—James R. Williams

(57) ABSTRACT

The invention includes an article and method for creating an erosion-resistant surface in a trough adapted to receive molten metal. The article includes a trough having a working lining and a pre-cast shape anchored at an erosion zone. The working lining and the precast shape define the interior volume of the trough. The precast shape can be anchored by, for example, mortar, undercuts, mechanical fasteners or, preferably, by combinations thereof. The method comprises casting a working lining within the trough and anchoring the precast shape at the erosion zone. The method includes installing a form in the trough, casting a working lining into the trough, and anchoring the erosion-resistant precast shape at the erosion zone. The form may be removable, and the precast shape may be at least a portion of the form. Conveniently, the form includes undercuts adapted to anchor the precast shape into the trough, and the precast shape includes mortar locks.

17 Claims, 4 Drawing Sheets

TROUGH HAVING AN EROSION-RESISTANT PRECAST SHAPE

FIELD OF THE INVENTION

The present invention relates to a precast refractory shape for use in the handling of molten metal, and particularly to a precast slag/iron interface in a blast furnace trough.

DESCRIPTION OF THE RELATED ART

In the production of metal articles, molten metal is often transferred from a first vessel through a trough. The trough will have at least one outlet through which the molten metal can pass to a second vessel or mold. For example, the production of iron comprises transferring molten iron from a blast furnace through a trough to a ladle.

A trough includes a metal shell having a refractory lining appropriate to the type of metal being cast. For iron, the lining often begins with a bed of a dry vibratable material over which precast blocks are set. Temporary forms are placed in the trough to define its interior shape. A castable refractory is then pumped or bucket-cast into the shell to create a working lining of the trough. Entrained air is removed by immersion vibrators and other mechanical means, thereby creating a low porosity material that conforms to the forms. The forms are removed after the castable hardens.

Forming a working lining from a castable refractory has various challenges, both from an installation and performance perspective. The castable has a limited working time and a viscosity that resists elimination of entrained air. Retained porosity can reduce mechanical performance and make the castable more susceptible to erosion and corrosion. The working lining should have a level surface; however, the geometry of the trough can make this difficult because a trough's bottom will often be sloped toward the outlets. Unless care is taken, the working lining can slump along the slope.

Use erodes the working lining of the trough. For example, the surface of the molten metal will typically be covered by slag, which can erode the working lining both chemically and mechanically. Slag thermally insulates and protects the metal from contact with air, which can reduce the quality of the finished product. Slag may comprise glasses, fluxes, insulating powders or various impurities. Erosion of the working lining requires that a trough be periodically taken out of service for reconditioning or replacement of the working lining. Downtime is costly, so working linings capable of extended times between reconditioning are very desirable. This requires working linings resistant to slag erosion.

In practice, a working lining can comprise at least two different castable refractories. A first castable is used for contact primarily with molten metal, and a second castable is intended primarily for contact with slag. The first castable often includes a majority of alumina and is cast and leveled into the trough where the iron/slag interface will be. The second castable is formulated to resist slag erosion and is cast on to first castable, preferably before the first castable has set. The second castable is often more costly than the first castable and can, for example, comprise up to 70 wt. % alumina, up to 60 wt. % silicon carbide and smaller amounts of a form of carbon, such as graphite.

Although the use of two castables improves performance, a number of installation difficulties arise from using two castables, including the need for pumping and leveling two castables instead of one, intermixing of the castables if the first castable has not set sufficiently, and formation of a cold joint between the castable layers if the first castable has set prematurely. Intermixing can increase costs without improving performance, and a cold joint is a potential failure point for break-through of the molten metal. Furthermore, the second castable cannot be isolated to specific regions of the trough without erection of a second set of removable forms. In use, "cold face" oxidation of the second castable can occur as carbides and carbon present in second castable begin to oxidize on a face of the lining away from the molten metal.

A need persists for a working lining that overcomes these difficulties and for a method of producing the same.

SUMMARY OF THE INVENTION

The objective of the present invention is to provide an article and method for creating an erosion-resistant surface in a trough for conveying molten metal. The article includes a trough having a working lining and a pre-cast shape anchored at an erosion zone. The method comprises casting a working lining within the trough and anchoring the precast shape so that the lining and shape define the interior volume of the trough.

The erosion zone can include an impact area where the molten metal enters the trough and any region contacting slag while the molten metal passes through the trough. The precast shape comprises up to 70 wt. % alumina, up to 60 wt. % silicon carbide, and up to 2 wt. % carbon.

The precast shape is described as anchored by mortar, undercuts and mechanical fasteners or, preferably, by combinations thereof. Mechanical fasteners include bolts, screws, T-bars or any other implement to secure the precast shape in the trough.

In another aspect of the invention, a method of manufacturing the trough is described. The trough includes a precast shape anchored at an erosion zone. The method includes installing a form in the trough, casting a working lining into the trough, and anchoring the erosion-resistant precast shape at the erosion zone. The form may be removable and in one embodiment the form includes the precast shape. Conveniently, the form includes undercuts adapted to anchor the precast shape into the trough.

DETAILED DESCRIPTION OF THE PREFERRED EMBODIMENTS

Figure 1:
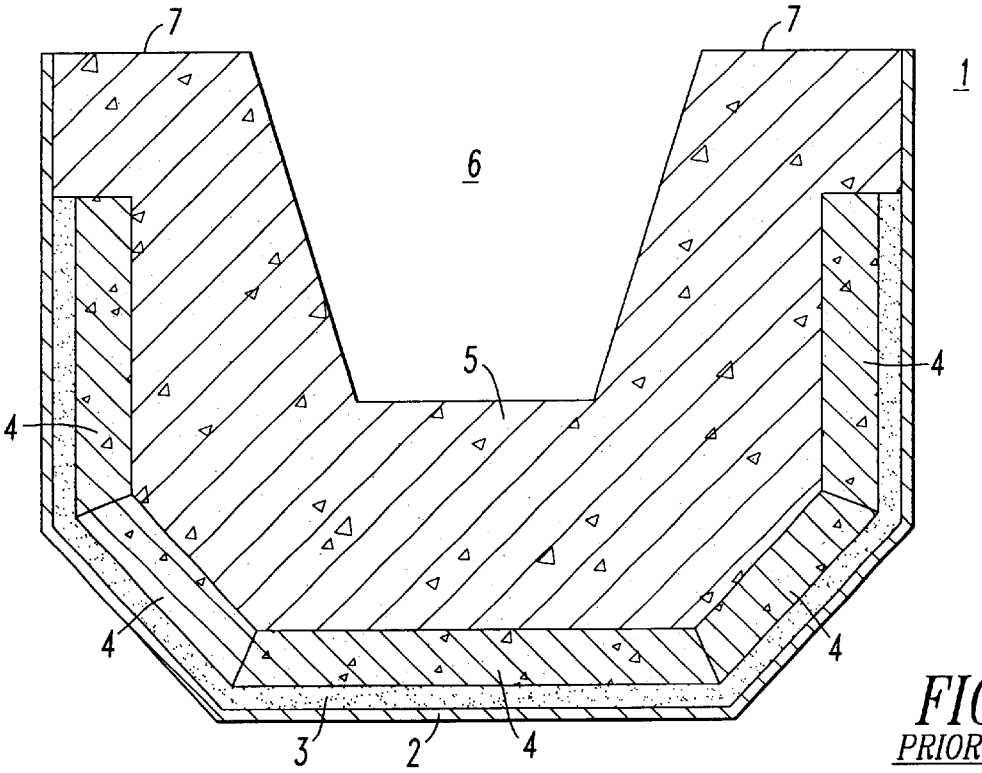
FIG. 1 PRIOR ART
FIG. 1 is a cross-section of a trough containing a working lining of the prior art.
Figure 2:
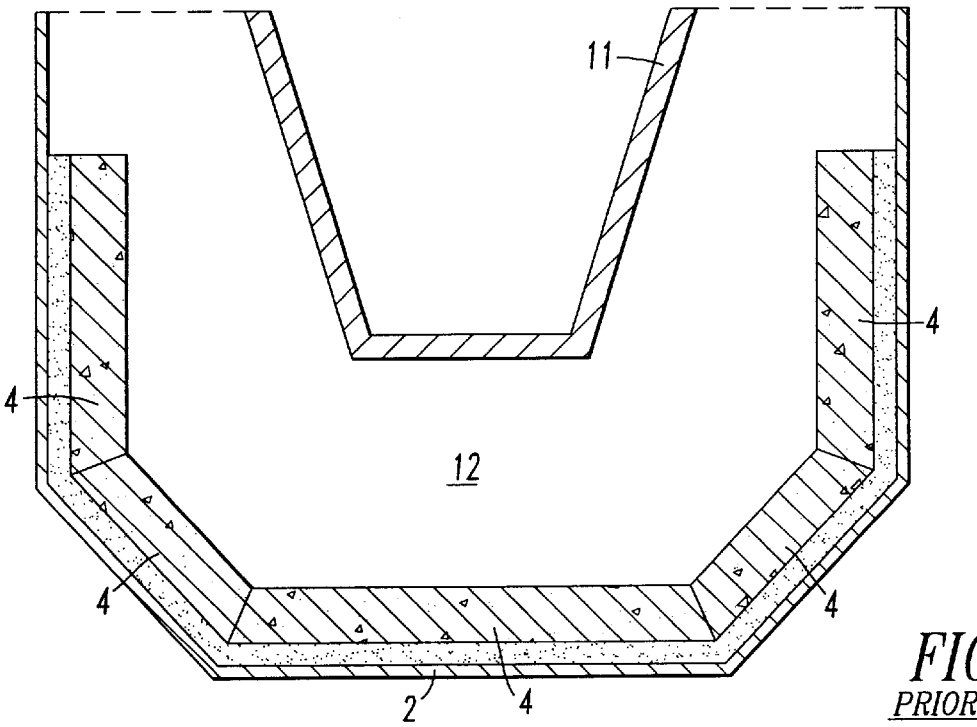
FIG. 2 PRIOR ART
FIG. 2 is a cross-section of a trough showing a form for defining the boundaries of a castable working lining.

Prior art troughs include a metal shell having a refractory working lining for the containment of molten metal. FIG. 1 depicts a prior art trough 1 having a metal shell 2 into which is placed a dry vibratable material 3. Precast blocks 4 support the vibratable compound 3 and hold it in place. A removable form 11 depicted in FIG. 2 is then placed in the trough 1 to define a working volume 12 between the form 11 and the metal shell 2 and precast blocks 4. A castable refractory is cast into the working volume 12. Care is taken to ensure the castable completely fills the working volume and entrapped air is expelled. Installers may employ probe vibrators and other tools to work the air from the castable. These tools are effective over only a limited volume of the castable, so installers must frequently repeat this process along the length of the trough 1 to ensure a good casting with low porosity. Proper installation also requires the castable to have a level surface 7 over the entire length of the trough 1. A non-level castable could cause spills of molten metal during use. A blast furnace trough 1 can be as long as sixty feet and must slope downwardly toward an outlet (not shown) so installers must work to avoid slumping of the castable along the trough's length. Once installed, the castable is allowed to harden and the forms are removed to reveal a working lining 5 that defines an interior volume 6 of the trough 1.

Figure 3A:
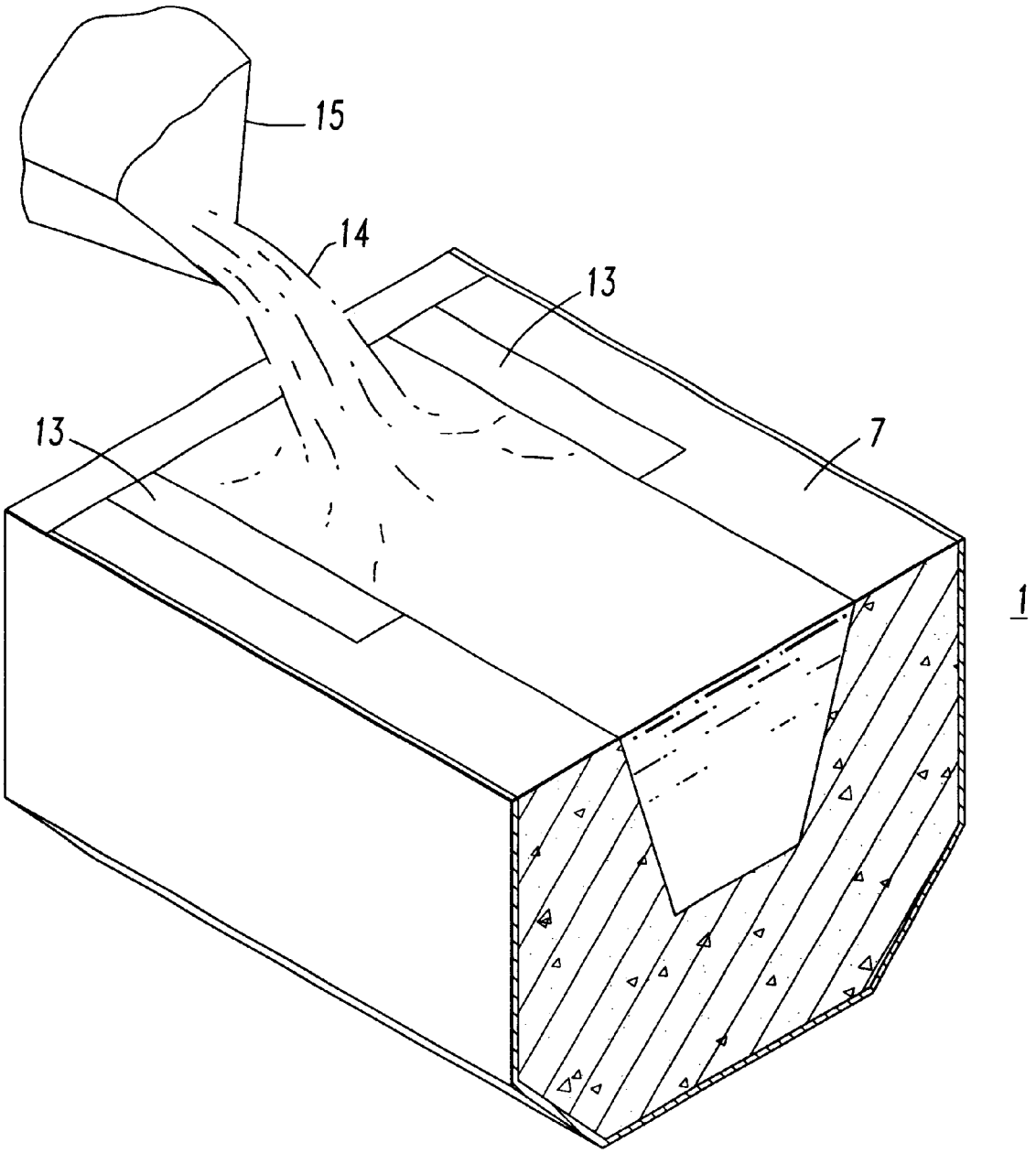
FIG. 3*a* is a top-side view of molten metal exiting a first vessel into a trough showing an erosion zone where molten metal enters the trough.
Figure 3B:
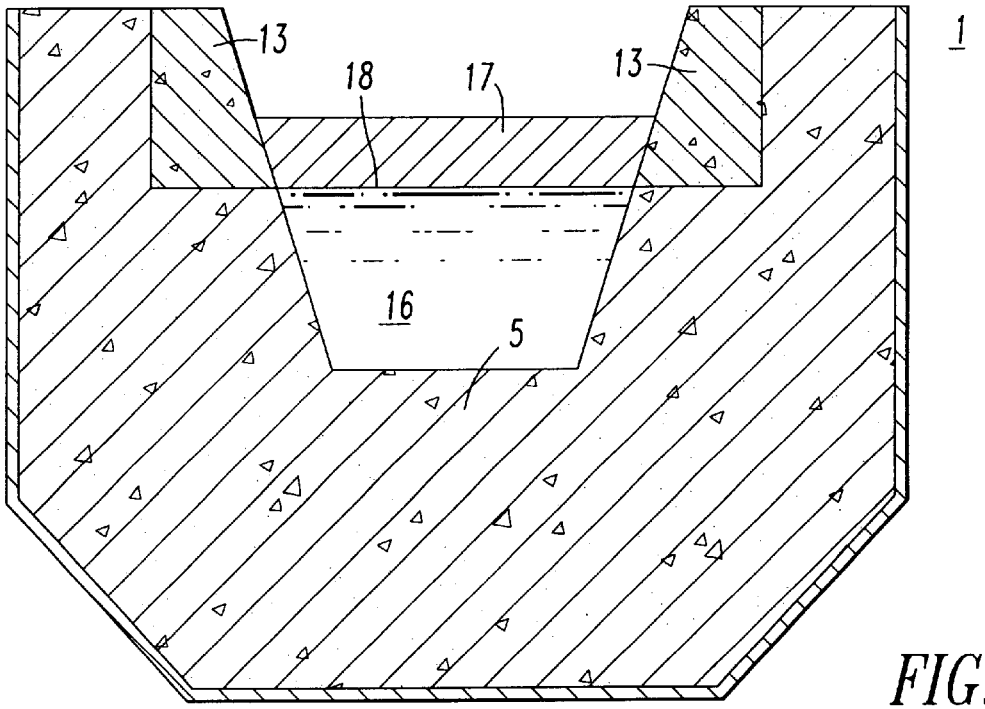
FIG. 3*b* is a cross-section of a trough showing an erosion zone at a slag layer.

A trough of the present invention comprises a metal shell, a working lining and a precast shape anchored at an erosion zone. An erosion zone is any region of the trough predisposed to erosion, such as by chemical or mechanical factors. In FIG. 3*a*, the erosion zone 13 comprises the level surface 7 of the trough 1 on which a stream 14 of molten metal pouring from a first vessel 15 impacts or splashes. In FIG. 3*b*, the erosion zone 13 comprises that portion of the working lining 5 above the slag/metal interface 18 that is in contact with the slag 17. Molten metal 16 is typically less erosive to a working lining than slag 17. Obviously, an erosion zone 13 is not limited to these embodiments and can include other parts of the trough 1, such as walls and floors of the interior volume 6.

Figure 4:
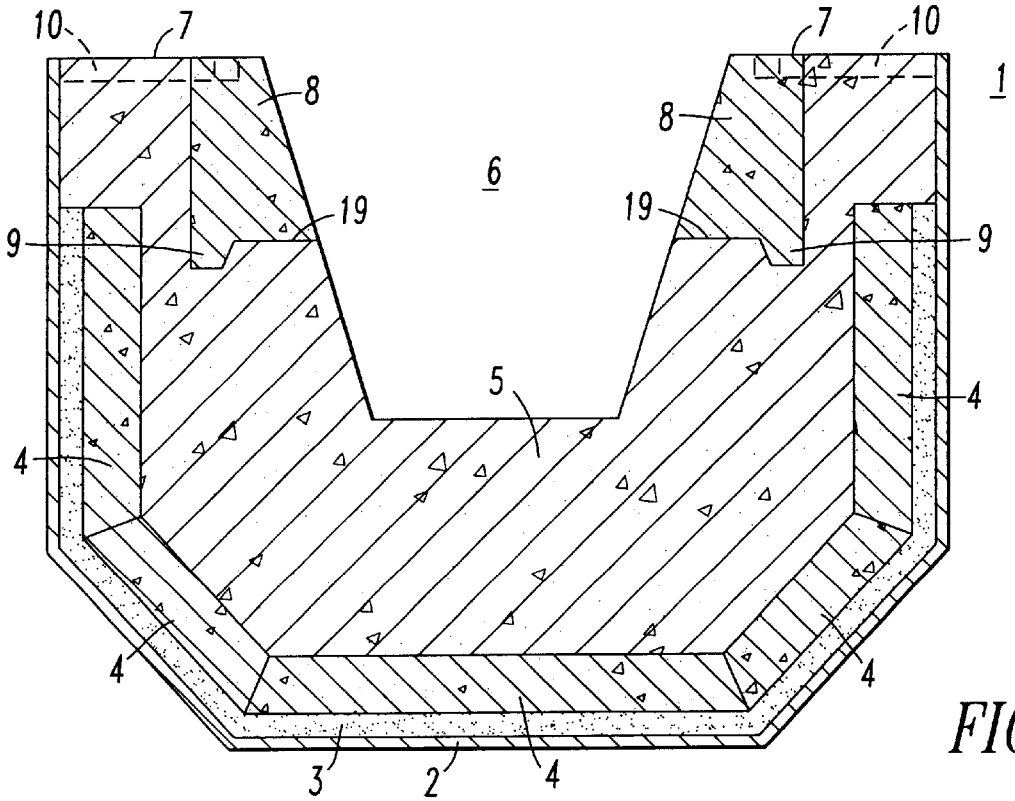
FIG. 4 is a cross-section of a trough having precast shapes.

In one embodiment, as shown in FIG. 4, the trough 1 has a metal shell 2, a dry vibratable material 3 and precast blocks 4. As in the prior art, removable forms (not shown) are placed in the trough 1 to define a working volume between the forms and the metal shall 2 and precast blocks 4. Unlike the prior art, the forms mold a castable refractory to accept a precast shape 8 at one or more erosion zones 13. Optionally, the forms include adaptations that produce an undercut 9 or anchoring channel 10 in the working lining 5. The precast shape 8 may even comprise at least a part of the form. In this configuration, the precast shape does not need to be set into the working lining after the castable has hardened and anchoring can be increased by providing protrusions or indentations around and into which the castable will harden. Such protrusions and indentations are identified as mortar locks.

The castable refractory is cast into the working volume as in the prior art. Conveniently, the forms define the shape of the hardened castable and can produce a predefined shelf 19 at an exact position without substantial effort by installers. Preferably, the shelf 19 is flat and level along the length of the trough; although, any reasonable geometry is possible. A precast shape 8 is finally set on the shelf 19, aligned with any undercuts 9 or anchoring channels 10, and anchored in place. Refractory mortar will often be used to adhere the precast shape to the working lining. A precise separation is defined between the working lining 5 and the precast shape 8, that is, between the working lining 5 and the erosion zone 13.

Obviously, if the precast shape 8 is part of the form 11, the precast shape 8 does not need to be set into the hardened castable. In this case, the precast shape can be precisely positioned before the castable refractory is cast, and the castable can be cast and vibrated around the precast shape. The hardened castable can effectively anchor the precast shape without a secondary anchoring structure, provided the precast includes at least one mortar lock. Examples of secondary anchoring structures include, for example, mortar and mechanical fasteners. Advantageously, the use of a precast shape as part of the form can reduce or eliminate the need for mortar, improve the contact between the precast shape and the castable, and reduce the amount of form that must be removed from the trough after casting.

The precast shape may comprise any erosion-resistant composition. For example, precast shapes for molten iron often comprise castable refractories with up to 70 wt. % alumina, up to 60 wt. % silicon carbide and up to 2 wt. % of a form of carbon, such as graphite. Erosion can be improved by the addition of stainless steel needles, such as, one inch long, 304 stainless needles. Advantageously, the precast shape is made at a different facility and time than the working lining. Advantages of precasting include the use of form vibrators, which release more entrapped air than probe vibrators, and controlled dry-out of the cast shape. Precast shapes can also include smaller articles that are pressed and fired into a hardened, erosion-resistant shape comprising, for example, zirconia, alumina, magnesia, silicon nitride, boron nitride, and zirconium diboride.

Figure 5:
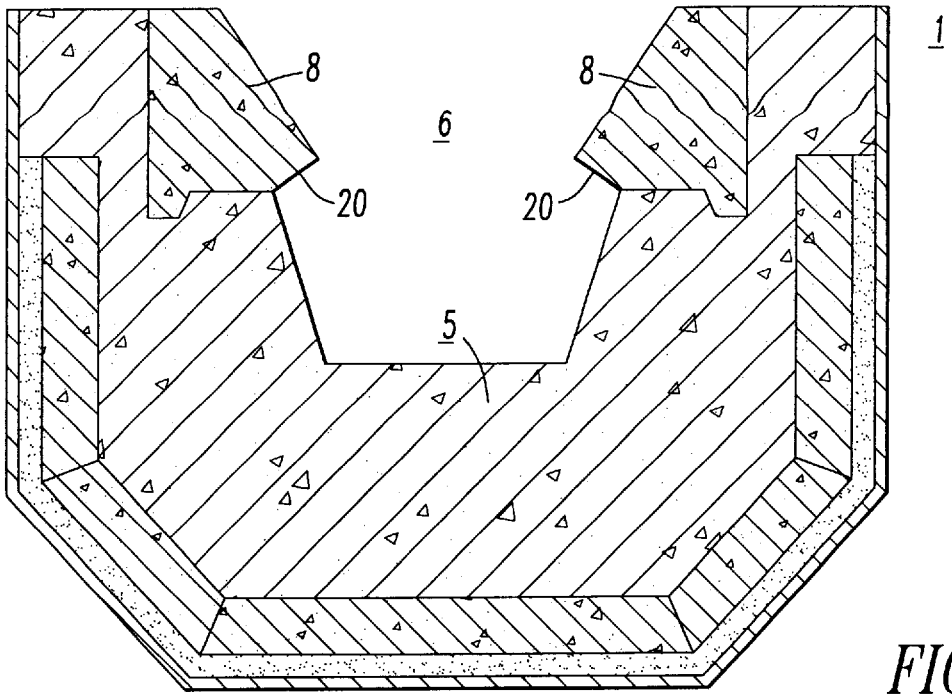
FIG. 5 is a cross-section of a trough showing precast shapes with an overhang.

A further advantage of the precast shape is the number of shapes that can be produced. For example, the precast shape can be made to lie flush with the working lining as shown in FIG. 4. The precast shape can also be made with excess material forming an overhang 20 as shown in FIG. 5. One would expect a precast shape 8 having excess material to resist erosion for longer periods than a precast shape without the excess material. This translates into longer life between rework and lower operating costs. An overhang 20 would be difficult to accomplish absent a precast shape 8. The form required to produce an overhang in a cast working lining would probably be multiple pieces, requiring assembly and disassembly before and after casting, respectively. Precast shapes could also be made to channel a stream of molten metal or slope toward or away from the interior volume.

Figure 6:
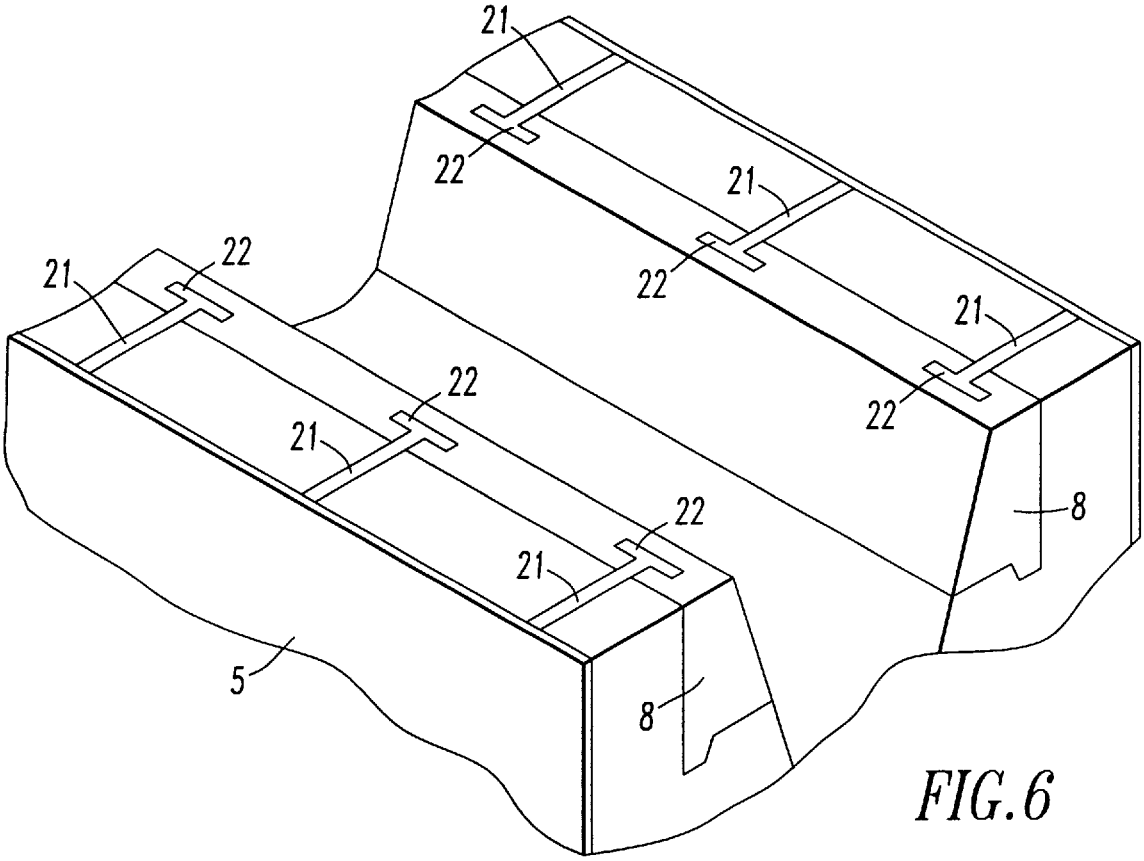
FIG. 6 is a top view of a trough showing T-bars for holding precast shapes in place.

The precast shape should be anchored at the erosion zone and preferably at least two anchoring systems hold the precast shape in place. Typically, the precast shape is mortared to the working lining. Undercuts, such as, for example, shiplap joints, mortices and tenons, improve mechanical interlocking. Additionally, mechanical fasteners, such as, screws, bolts and other fasteners, can be used to lock the precast shape at the erosion zone. In another emobodiment, FIG. 6 shows precast shapes anchored by a plurality of T-bars, each comprising a T-coupling 22 and accompanying bar 21. The T-bars frictionally hold the precast shape.

Obviously, numerous modifications and variations of the present invention are possible. It is, therefore, to be understood that within the scope of the following claims, the invention may be practiced otherwise than as specifically described.

What is claimed is:

1. A trough adapted to receive and convey molten metal and slag, the trough having an erosion zone, which comprises an impact area and is adapted to contact an interface formed by the molten metal and slag, the trough comprising;

a metal shell having a working volume;

a working liner comprising a castable refractory at least partially within the working volume;

a precast shape having greater erosion-resistance than the working lining anchored at the erosion zone so that the working liner and precast shape define an interior volume for containing the molten metal, wherein the precast shape and the working lining define a joint and the joint does not extend towards the metal shell beyond the working lining.

2. The trough of claim 1, wherein the precast shape comprises up to 70 wt. % alumina, up to 60 wt. % silicon carbide, and up to 2 wt. % carbon.

3. The trough of claim 1, wherein the precast shape is anchored at the erosion zone by mortar.

4. The trough of claim 1, wherein the precast shape is anchored at the erosion zone by an undercut in the working liner.

5. The trough of claim 1, wherein the precast shape comprises mortar locks for anchoring the precast shape to the working lining.

6. The trough of claim 1, wherein the precast shape is anchored at the erosion zone by a mechanical fastener.

7. The trough of claim 6, wherein the mechanical fastener is selected from the group consisting of a bolt, a screw, a T-bar and a plate.

8. A method of manufacturing a trough adapted to receive and convey molten metal along an interior volume defined by a working lining and a erosion-resistant precast shape, the method comprising:

placing a form into the metal shell to create a working volume between the metal shell and the form;

casting a castable refractory into the working volume;

allowing the castable refractory to harden to form the working lining;

anchoring the precast shape to the working lining, thereby forming adjoint between the precast shape and the working lining and wherein the joint does not extend towards the metal shell beyond the working lining.

9. The method of claim 8, further comprising removing the form after allowing the castable refractory to harden and before anchoring the precast shape.

10. The method of claim 8, further comprising providing at least one undercut in the working lining to anchor the precast shape.

11. The method of claim 10, wherein the form provides the undercut in the working lining.

12. The method of claim 11, wherein the undercuts are adapted to receive a mechanical fastener for anchoring the precast shape.

13. The method of claim 11, wherein the precast shape comprises at least a portion of the form.

14. A method of manufacturing a trough adapted to receive in and convey molten metal along an interior volume defined by a working lining and a erosion-resistant precast shape, the method comprising:

placing the precast shape and a form into the metal shell to create a working volume between the metal shell and the precast shape and form;

casting a castable refractory into the working volume;

allowing the castable refractory to harden to form the working lining, thereby forming adjoint between the precast shape and the working lining and wherein the joint does not extend towards the metal shell beyond the working lining.

15. The method of claim 14, further comprising anchoring the precast shape with secondary anchoring structures.

16. The method of claim 14, wherein the precast shape comprises mortar locks.

17. The method of claim 14, further comprising removing the form after allowing the castable to harden.

* * * * *